US007565289B2

(12) United States Patent
Rogers

(10) Patent No.: US 7,565,289 B2
(45) Date of Patent: Jul. 21, 2009

(54) ECHO AVOIDANCE IN AUDIO TIME STRETCHING

(75) Inventor: Kevin Christopher Rogers, Albany, CA (US)

(73) Assignee: Apple Inc., Cupertino, CA (US)

( * ) Notice: Subject to any disclaimer, the term of this patent is extended or adjusted under 35 U.S.C. 154(b) by 729 days.

(21) Appl. No.: 11/240,729

(22) Filed: Sep. 30, 2005

(65) Prior Publication Data

US 2007/0078650 A1 Apr. 5, 2007

(51) Int. Cl.
*G10L 19/02* (2006.01)

(52) U.S. Cl. ..... 704/229; 704/226; 704/224

(58) Field of Classification Search ..... 379/406.08, 379/406.12, 3; 704/200, 226, 227, 228, 229, 704/224, 210

See application file for complete search history.

(56) References Cited

U.S. PATENT DOCUMENTS 5,528,687 A * 6/1996 Tanaka et al. ..... 379/406.12

6,928,161 B1 * 8/2005 Graumann ..... 379/406.08

OTHER PUBLICATIONS

Puckette, Miller, "Phase-locked Vocoder," IEEE , Reprinted from Proceedings, IEEE ASSP Conference on Applications of Signal Processing to Audio and Acoustics (Mohonk, N.Y.) 1995.

* cited by examiner

*Primary Examiner*—Huyen X. Vo
(74) *Attorney, Agent, or Firm*—Fish & Richardson P.C.

(57) ABSTRACT

A transient echo can be avoided during time stretching of a digital audio signal by detecting a transient in a frame of a digital audio signal, identifying another occurrence of the transient in a subsequent frame of the digital audio signal, rotating the transient occurring in the subsequent frame to align the transient occurring in the subsequent frame with the transient detected in the frame, and aggregating the frame with the subsequent frame. Further, another occurrence of the transient can be identified in another subsequent frame of the digital audio signal and it can be determined that the transient occurring in that subsequent frame cannot be aligned with the transient detected in the frame. The copy of the transient occurring in the another subsequent frame can then be blended across that frame, such as by performing phase accumulation on one or more frequency components.

24 Claims, 9 Drawing Sheets

ECHO AVOIDANCE IN AUDIO TIME STRETCHING

BACKGROUND

The present disclosure relates to digital audio signals and to avoiding echoes associated with transients included in time stretched digital audio signals.

Digital-based electronic media formats have become widely accepted. The development of faster computer processors, high-density storage media, and efficient compression and encoding algorithms have led to an even more widespread implementation of digital audio media formats in recent years. Digital compact discs (CDs) and digital audio file formats, such as MP3 (MPEG Audio-layer 3) and WAV, are now commonplace. Some of these formats store the digitized audio information in an uncompressed state while others use compression. The ease with which digital audio files can be generated, duplicated, and disseminated also has helped increase their popularity.

Audio information can be detected as an analog signal and represented using an almost infinite number of electrical signal values. An analog audio signal is subject to electrical signal impairments, however, that can negatively affect the quality of the recorded information. Any change to an analog audio signal value can result in a noticeable defect, such as distortion or noise. Because an analog audio signal can be represented using an almost infinite number of electrical signal values, it is also difficult to detect and correct defects. Moreover, the methods of duplicating analog audio signals cannot approach the speed with which digital audio files can be reproduced. These and many other problems associated with analog audio signals can be overcome, without a significant loss of information, simply by digitizing the audio signals.

FIG. 1 presents a portion of an analog audio signal 100. The amplitude of the analog audio signal 100 is shown with respect to the vertical axis 105 and the horizontal axis 110 indicates time. In order to digitize the analog audio signal 100, the waveform 115 is sampled at periodic intervals, such as at a first sample point 120 and a second sample point 125. A sample value representing the amplitude of the waveform 115 is recorded for each sample point. If the sampling rate is less than twice the frequency of the waveform being sampled, the resulting digital signal will be substantially identical to the result obtained by sampling a waveform of a lower frequency. As such, in order to be adequately represented, the waveform 115 must be sampled at a rate greater than twice the highest frequency that is to be included in the reconstructed signal. To ensure that the waveform is free of frequencies higher than one-half of the sampling rate, which is also known as the Nyquist frequency, the audio signal 100 can be filtered prior to sampling. Therefore, in order to preserve as much audible information as possible, the sampling rate should be sufficient to produce a reconstructed waveform that cannot be differentiated from the waveform 115 by the human ear.

The human ear generally cannot detect frequencies greater than 16-20 kHz, so the sampling rate used to create an accurate representation of an acoustic signal should be at least 32 kHz. For example, compact disc quality audio signals are generated using a sampling rate of 44.1 kHz. Once the sample value associated with a sample point has been determined, it can be represented using a fixed number of binary digits, or bits. Encoding the infinite possible values of an analog audio signal using a finite number of binary digits will almost necessarily result in the loss of some information. Because high-quality audio is encoded using up to 24-bits per sample, however, the digitized values closely approximate the original analog values. The digitized values of the samples comprising the audio signal can then be stored using a digital-audio file format.

The acceptance of digital-audio has increased dramatically as the amount of information that is shared electronically has grown. Digital-audio file formats, such as MP3 (MPEG Audio-layer 3) and WAV, that can be transferred between a wide variety of hardware devices are now widely used. In addition to music and soundtracks associated with video information, digital-audio is also being used to store information such as voice-mail messages, audio books, speeches, lectures, and instructions.

The characteristics of digital-audio and the associated file formats also can be used to provide greater functionality in manipulating audio signals than was previously available with analog formats. One such type of manipulation is filtering, which can be used for signal processing operations including removing various types of noise, enhancing certain frequencies, or equalizing a digital audio signal. Another type of manipulation is time stretching, in which the playback duration of a digital audio signal is increased or decreased, either with or without altering the pitch. Time stretching can be used, for example, to increase the playback duration of a signal that is difficult to understand or to decrease the playback duration of a signal so that it can be reviewed in a shortened time period. Compression is yet another type of manipulation, by which the amount of data used to represent a digital audio signal is reduced. Through compression, a digital audio signal can be stored using less memory and transmitted using less bandwidth. Digital audio processing strategies include MP3, AAC (MPEG-2 Advanced Audio Codec), and Dolby Digital AC-3.

Many digital audio processing strategies manipulate the digital audio data in the frequency domain. In performing this processing, the digital audio data can be transformed from the time domain into the frequency domain block by block, each block being comprised of multiple discrete audio samples. By manipulating data in the frequency domain, however, some characteristics of the audio signal can be lost. For example, an audio signal can include a substantial signal change, referred to as a transient, that can be differentiated from a steady-state signal. A transient is typically characterized by a sharp increase and decrease in amplitude that occur over a very short period of time. The signal information representing a transient can be lost during frequency domain processing, which commonly results in a pre-echo or transient smearing that diminishes the quality of the digital audio signal.

In order to transform a digital audio signal from the time domain, a processing algorithm can convert the blocks of samples into the frequency domain using a Discrete Fourier Transform (DFT), such as the Fast Fourier Transform (FFT). The number of individual samples included in a block defines the time resolution of the transform. Once transformed into the frequency domain, the digital audio signal can be represented using magnitude and phase information, which describe the spectral characteristics of the block. After the window of digital audio data has been processed, and the spectral characteristics of the window have been determined, the digital audio data can be converted back into the time domain using an Inverse Discrete Fourier Transform (IDFT), such as the Inverse Fast Fourier Transform (IFFT).

A phase vocoder is an example of a system that processes digital audio signals in the frequency domain. One application of the phase vocoder is to time stretch a digital audio signal. If the digital audio signal includes a transient, however, time stretching can result in the transient being smeared or diffused across the audio signal, or in the transient being audible multiple times. Consequently, playback or further processing of the stretched digital audio signal can be distorted or deteriorated, often resulting in echoes of transients within stretched audio signals.

SUMMARY

The present inventor recognized the need to detect transients during frequency domain processing of a digital audio signal. Further, the need to process the digital audio signal to avoid smearing or diffusion of a transient across the digital audio signal is recognized. In addition, the need to process the digital audio signal to avoid multiple representations, or echoes, of a transient also is recognized. Accordingly, the techniques and apparatus described here implement algorithms for the accurate detection and processing of transients in a frequency domain representation of a digital audio signal.

In general, in one aspect, the techniques can be implemented to include detecting a transient in a frame of a digital audio signal; identifying another occurrence of the transient in a subsequent frame of the digital audio signal; rotating the transient occurring in the subsequent frame to align the transient occurring in the subsequent frame with the transient detected in the frame; and aggregating the frame with the subsequent frame.

The techniques also can be implemented such that rotating the transient comprises applying a linear phase offset to one or more components associated with the transient occurring in the subsequent frame. Further, the techniques can be implemented such that detecting a transient in a frame comprises detecting one or more spectral characteristics associated with a frequency domain representation of the frame that are representative of a transient. Additionally, the techniques can be implemented to include performing phase accumulation on one or more sinusoidal components associated with the frame.

The techniques also can be implemented to include identifying another occurrence of the transient in another subsequent frame of the digital audio signal; determining that the occurrence of the transient in the another subsequent frame cannot be aligned with the transient detected in the frame; and blending the occurrence of the transient in the another subsequent frame across the another subsequent frame. Additionally, the techniques can be implemented such that blending the occurrence of the transient comprises performing phase accumulation on one or more frequency components associated with the another subsequent frame.

In general, in another aspect, the techniques can be implemented to include detecting a transient in a frame of a digital audio signal; identifying another occurrence of the transient in at least one subsequent frame of the digital audio signal; determining that the occurrence of the transient in the at least one subsequent frame cannot be aligned with the transient detected in the frame; and blending the occurrence of the transient in the at least one subsequent frame across the at least one subsequent frame.

The techniques also can be implemented such that blending the occurrence of the transient comprises performing phase accumulation on one or more frequency components associated with the at least one subsequent frame. Further, the techniques can be implemented such that detecting a transient in a frame comprises detecting one or more spectral characteristics associated with a frequency domain representation of the frame that are representative of a transient.

In general, in another aspect, the techniques can be implemented to include machine-readable instructions for avoiding a transient echo during time stretching of a digital audio signal, the machine-readable instructions being operable to perform operations comprising detecting a transient in a frame of a digital audio signal; identifying another occurrence of the transient in a subsequent frame of the digital audio signal; rotating the transient occurring in the subsequent frame to align the transient occurring in the subsequent frame with the transient detected in the frame; and aggregating the frame with the subsequent frame.

The techniques also can be implemented such that the machine-readable instructions for rotating are further operable to perform operations comprising applying a linear phase offset to one or more components associated with the transient occurring in the subsequent frame. Further, the techniques can be implemented such that the machine-readable instructions for detecting a transient in a frame are further operable to perform operations comprising detecting one or more spectral characteristics associated with a frequency domain representation of the frame that are representative of a transient. Additionally, the techniques can be implemented to include machine-readable instructions operable to perform operations comprising performing phase accumulation on one or more sinusoidal components associated with the frame.

The techniques also can be implemented to include machine-readable instructions operable to perform operations comprising identifying another occurrence of the transient in another subsequent frame of the digital audio signal; determining that the occurrence of the transient in the another subsequent frame cannot be aligned with the transient detected in the frame; and blending the occurrence of the transient in the another subsequent frame across the another subsequent frame. Further, the techniques can be implemented such that the machine-readable instructions for blending the occurrence of the transient are further operable to perform operations comprising performing phase accumulation on one or more frequency components associated with the another subsequent frame.

In general, in another aspect, the techniques can be implemented to include machine-readable instructions for avoiding a transient echo during time stretching of a digital audio signal, the machine-readable instructions being operable to perform operations comprising detecting a transient in a frame of a digital audio signal; identifying another occurrence of the transient in at least one subsequent frame of the digital audio signal; determining that the occurrence of the transient in the at least one subsequent frame cannot be aligned with the transient detected in the frame; and blending the occurrence of the transient in the at least one subsequent frame across the at least one subsequent frame.

The techniques also can be implemented such that the machine-readable instructions for blending the occurrence of the transient are further operable to perform operations comprising performing phase accumulation on one or more frequency components associated with the at least one subsequent frame. Further, the techniques can be implemented such that the machine-readable instructions for detecting a transient in a frame are further operable to perform operations comprising detecting one or more spectral characteristics associated with a frequency domain representation of the frame that are representative of a transient.

In general, in another aspect, the techniques can be implemented to include processor electronics configured to perform operations comprising detecting a transient in a frame of a digital audio signal; identifying another occurrence of the transient in a subsequent frame of the digital audio signal; rotating the transient occurring in the subsequent frame to align the transient occurring in the subsequent frame with the transient detected in the frame; and aggregating the frame with the subsequent frame.

The techniques also can be implemented such that the processor electronics are further configured to perform operations comprising rotating the transient by applying a linear phase offset to one or more components associated with the transient occurring in the subsequent frame. Further, the techniques can be implemented such that the processor electronics are further configured to perform operations comprising performing phase accumulation on one or more sinusoidal components associated with the frame. Additionally, the techniques can be implemented to include processor electronics configured to perform operations comprising identifying another occurrence of the transient in another subsequent frame of the digital audio signal; determining that the occurrence of the transient in the another subsequent frame cannot be aligned with the transient detected in the frame; and blending the occurrence of the transient in the another subsequent frame across the another subsequent frame.

In general, in another aspect, the techniques can be implemented to include processor electronics configured to perform operations comprising detecting a transient in a frame of a digital audio signal; identifying another occurrence of the transient in at least one subsequent frame of the digital audio signal; determining that the occurrence of the transient in the at least one subsequent frame cannot be aligned with the transient detected in the frame; and blending the occurrence of the transient in the at least one subsequent frame across the at least one subsequent frame. Additionally, the techniques can be implemented such that the processor electronics configured to blend the occurrence of the transient are further configured to perform operations comprising performing phase accumulation on one or more frequency components associated with the at least one subsequent frame.

The techniques described in this specification can be implemented to realize one or more of the following advantages. For example, the techniques can be implemented to permit a digital audio signal to be processed in the frequency domain utilizing a constant block size. The techniques also can be implemented to permit a digital audio signal to be processed in the frequency domain without first identifying transients in the time domain. Further, the techniques can be implemented to align transients within time stretched digital audio signals. Moreover, the techniques can be implemented to avoid smearing or diffusion of transients across time stretched audio signals. Additionally, the techniques can be implemented to avoid echoes of transients in time stretched digital audio signals. In other words, the techniques can be implemented to maintain clarity of transients within stretched digital audio signals.

These general and specific techniques can be implemented using an apparatus, a method, a system, or any combination of an apparatus, methods, and systems. The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A digital audio signal can be time stretched such that a transient included in the audio signal is audible only once in the stretched audio signal. Time stretching a digital audio signal refers to expanding or contracting the length of the audio signal, such as the playback duration, with or without changing a pitch associated with the digital audio signal. Copies of a transient, both complete and partial, appearing in adjacent analysis frames within the digital audio signal are rotated for alignment of the transient copies between the re-synthesis frames. During processing, it may not be possible to rotate a transient sufficiently to align the transient with an earlier copy of that transient. For example, the earlier copy of the transient can appear at a time that is outside of the particular re-synthesis frame. Consequently, the stretched audio signal can include multiple copies of the transient. In order to ensure that only the actual transient is audible in the time stretched audio signal, the subsequent copies of the transient are blended into the stretched audio signal, rendering them inaudible.

Figure 1:
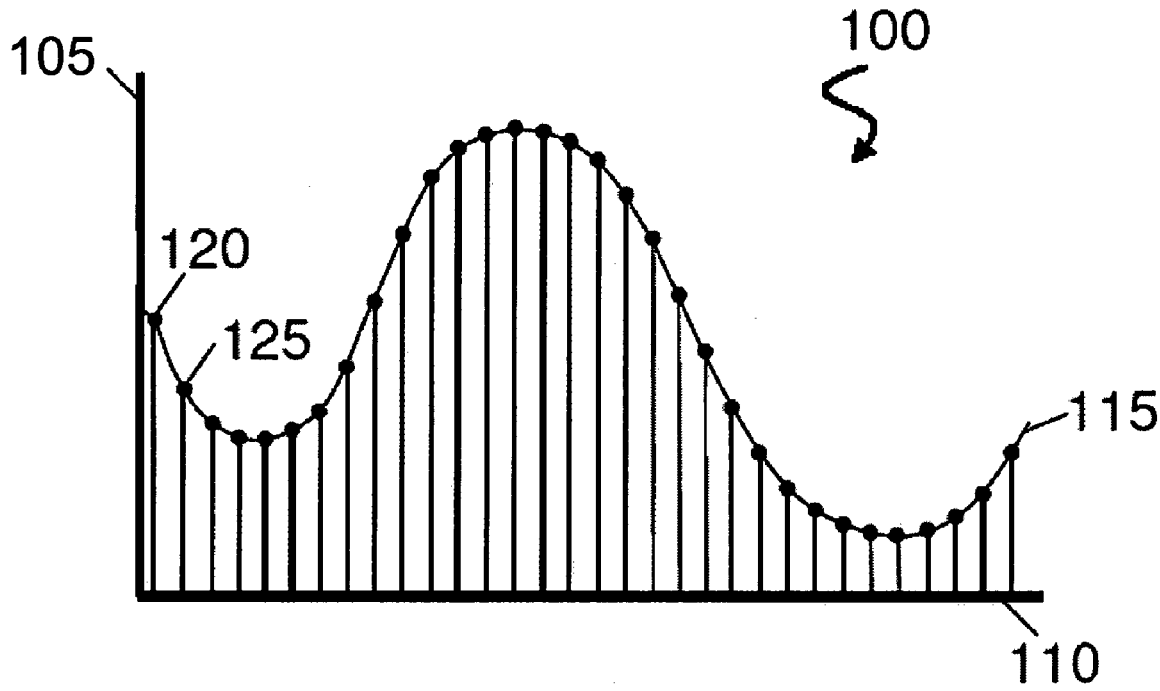
FIG. 1 is an illustration of an analog waveform.
Figure 2:
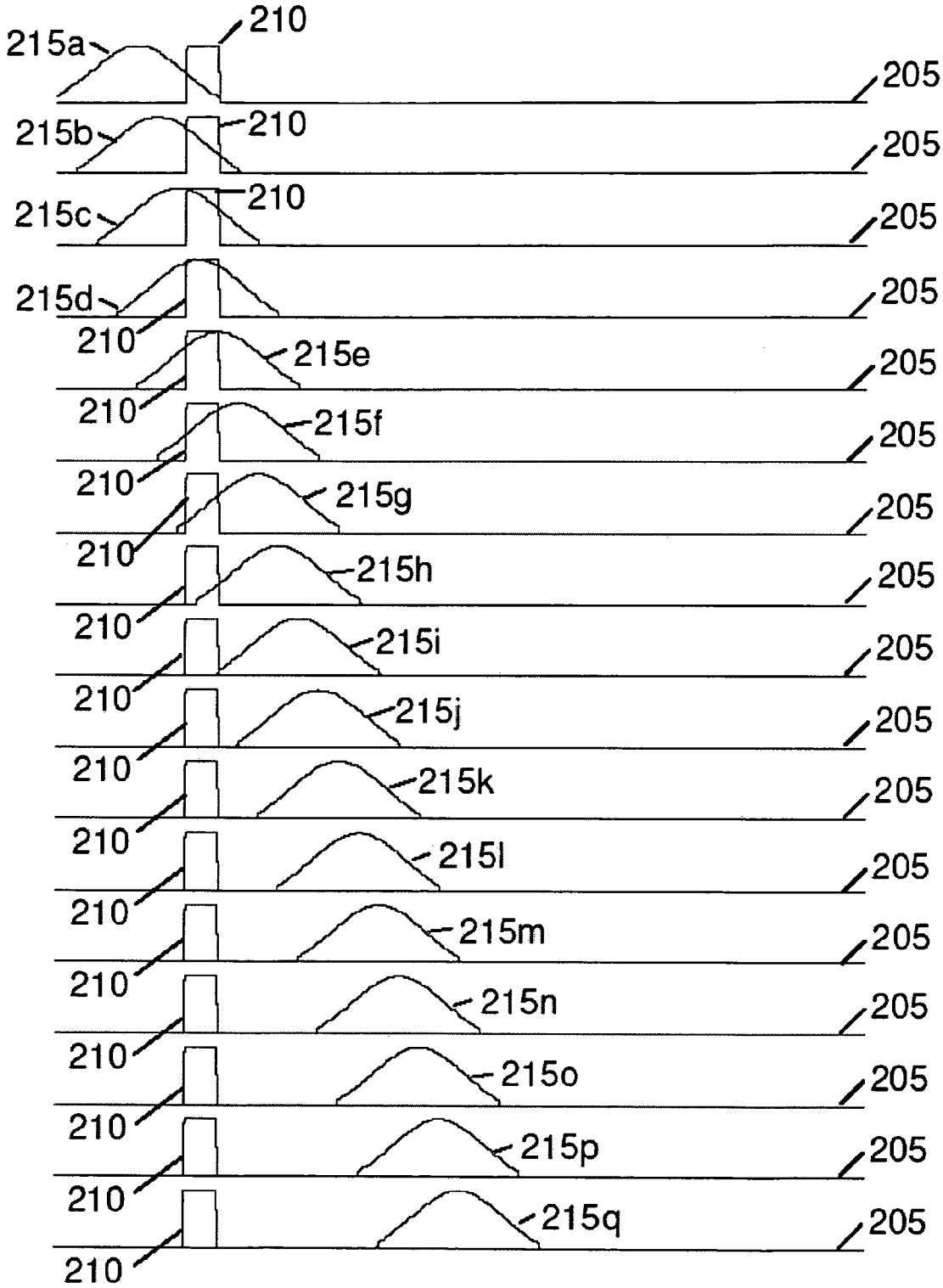
FIG. 2 is an illustration of an audio signal prior to being time stretched.

Referring to FIG. 2, a digital audio signal 205 including a transient 210 is provided as an input audio signal for time stretching. The audio signal 205 is processed in discrete segments defined by frames 215*a*-215*q*. The audio signal 205 and the transient 210 are repeated multiple times in FIG. 2 such that each of the frames 215*a*-215*q* may be illustrated individually with respect to the audio signal 205 and the transient 210.

The audio signal 205 is illustrated in FIG. 2 as a flat line. In typical implementations, however, the audio signal 205 can include multiple sinusoidal components characterized by varying amplitudes. Nonetheless, the audio signal 205 is shown as a flat line to illustrate that the majority of the audio signal 205 is a baseline, or steady-state, from which the transient 210 deviates.

The transient 210 represents a portion of the audio signal 205 corresponding to a rapidly changing sound having a short duration. The transient 210 stands in contrast to the long-lasting and relatively stable sinusoidal components forming the baseline of the audio signal 205. Examples of transients that can occur in the audio signal 205 include a door slam, a hand clap, a drum beat, an initial strumming of a guitar, or a short and loud vocal exclamation.

Each of the frames 215*a*-215*q* represents a portion of the audio signal 205 that is processed as a discrete whole. For example, a Fourier transform may be applied to the portion of the audio signal appearing within one of the frames 215*a*-215*q*, and the frequency domain representation of the portion of the audio signal may be processed further. The curve of the analysis window used to create the frames 215*a*-215*q* can represent a weighting function that is applied to the audio signal 205 to ensure smooth transitions between adjacent analysis frames. In other words, the analysis windows used to create the frames 215*a*-215*q* can be applied to the audio signal 205 as defined by Short Time Fourier Transform (STFT), in which each analysis window is multiplied by a portion of the audio signal included within the analysis window to produce a corresponding analysis frame. The discrete frames 215*a*-215*q* that are defined by the analysis windows may be reassembled after processing in an operation called re-synthesis. During re-synthesis, portions of the audio signal included in overlapping ones of the frames 215*a*-215*q* are aggregated to produce the reassembled audio signal. In an implementation, overlap-add re-synthesis is used to reassemble the audio signal 205 from the re-synthesis frames.

The distance between adjacent pairs of the analysis frames 215*a*-215*q* is known as the input hop size or the input step size. In an implementation, the input hop size is measured as the number of samples by which the two analysis windows are offset. The time scale of the audio signal 205 can be expanded or contracted prior to re-synthesis in a process known as time stretching by increasing or decreasing the distances between adjacent pairs of the frames 215*a*-215*q*. Each of the re-synthesis frames 215*a*-215*q* can be shifted to increase or decrease the offsets between the re-synthesis frames 215*a*-215*q*. Such shifting and repositioning of the analysis frames changes the overall length of the audio signal 205, which time stretches the audio signal 205. The distance between adjacent pairs of the re-synthesis frames 215*a*-215*q* after time stretching is known as the output hop size or the output step size. The amount by which the audio signal 205 has been time stretched depends on the difference between the input step size and the output step size.

Figure 3:
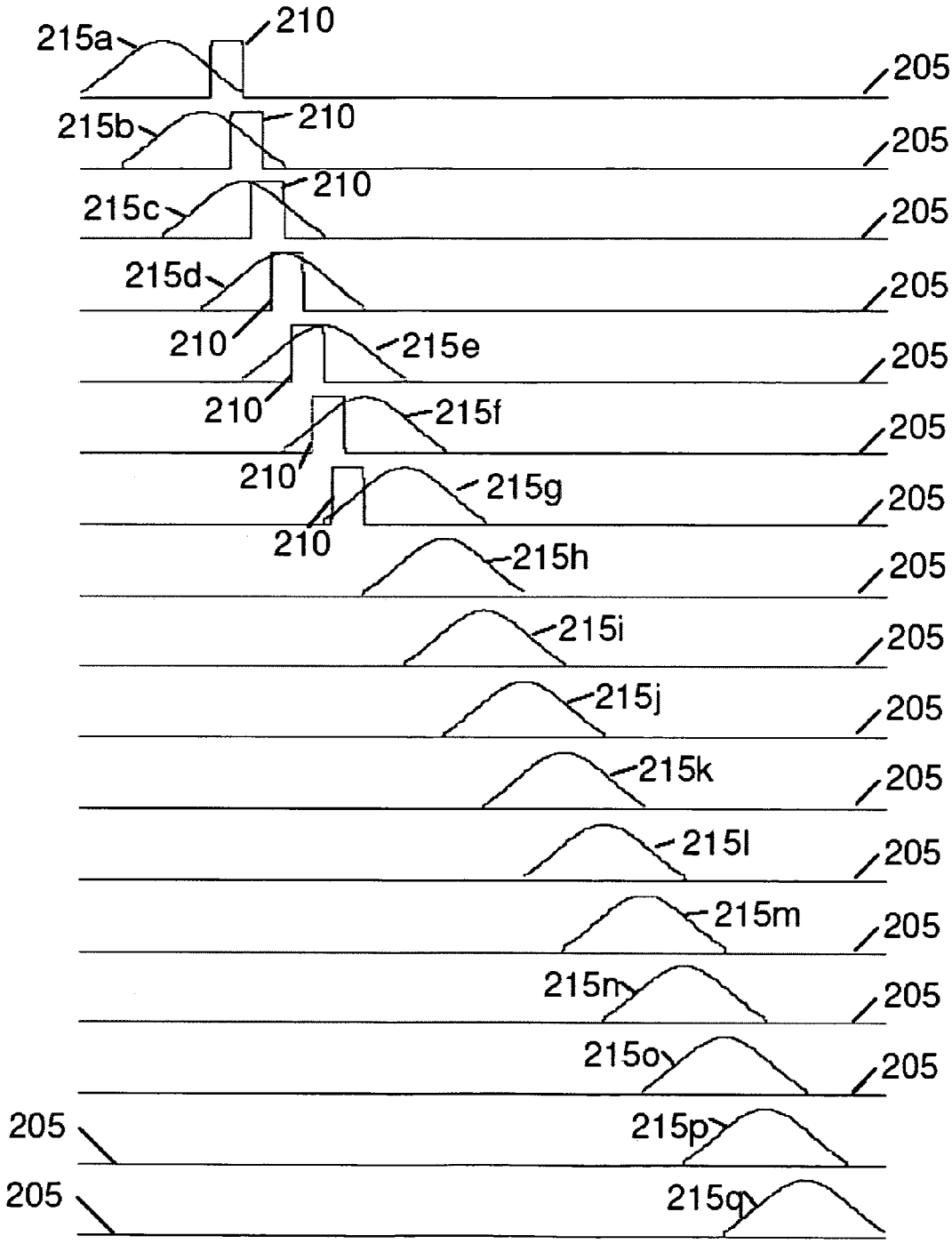
FIG. 3 is an illustration of an audio signal after being time stretched without analysis frame rotation.

For example, referring also to FIG. 3, the time scale of the audio signal 205 has been expanded by a factor of two, so the offsets between the frames 215*a*-215*q* has been doubled. As a result of shifting the frames 215*a*-215*q*, the transient 210 does not appear within the audio signal 205 at the same point for each of the frames 215*a*-215*q*. Therefore, when re-synthesizing the audio signal 205 after the time scale has been changed, the transient 210 will appear at multiple different times. Consequently, the transient 210 is repeatedly audible in the re-synthesized audio signal, and the transient 210 will be processed multiple times as the re-synthesized audio signal is processed.

Figure 4:
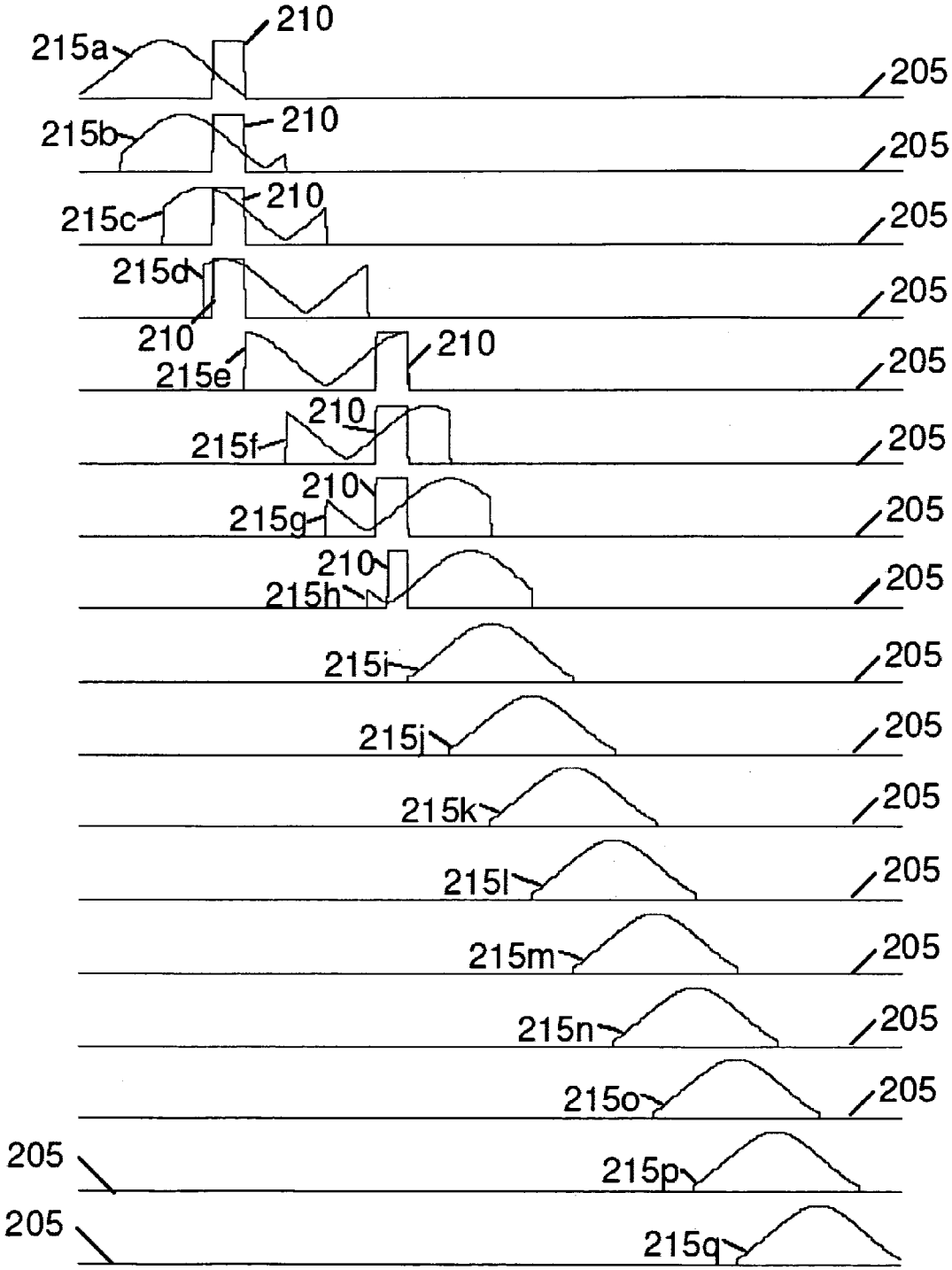
FIG. 4 is an illustration of an audio signal after being time stretched with analysis frame rotation.

Referring to FIG. 4, copies of the transient 210 appearing within the frames 215*a*-215*q* can be rotated such that the transient 210 appears at the same time within each of the frames 215*a*-215*q*. Rotating a copy of the transient 210 appearing within one of the frames 215*a*-215*q* includes shifting the copy of the transient 210 by an amount that causes the copy of the transient 210 to be aligned with a copy of the transient 210 included in another frame. Shifting the transient 210 can cause the transient 210 to be shifted beyond one end the analysis frame. To compensate, the transient 210 can be moved to the opposite side of the analysis frame, or wrapped, where space has been created for the transient 210 by the shift. For example, the frames 215*b*-215*d* and the corresponding copies of the transient 210 that are illustrated in FIG. 3 have been rotated such that the transient 210 appears within the frames 215*b*-215*d* at a time at which the transient 210 appears within the analysis frames 215*a*, as illustrated in FIG. 4.

In some instances, it may not be possible to rotate the transient copy appearing in the present frame such that the transient copy is aligned in the frame with the transient as it appears in all of the remaining frames. For example, the transient can appear in one or more other frames at a time that is not included in the present frame. More particularly, the frame 215*e* cannot be rotated to align the transient 210 as it appears within the frame 215*e* with the transient 210 as it appears in the frames 215*a*-215*d*, because the time at which the transient 210 appears within the frames 215*a*-215*d* is not included in the frame 215*e*. However, the frame can be rotated to align the transient 210, as it appears within the frame 215*e*, with instances of the transient 210 that appear within other frames. For example, the frames 210*e*-210*h* can be rotated to align the transients 210 appearing within those frames.

Therefore, the transient 210 appears once at a time included in the frames 215*a*-215*d*, and once at a time included in the frames 215*e*-215*h*. The second instance of the transient 210 appearing within the frames 215*e*-215*h* represents an echo of the transient 210 that appears within the frames 215*a*-215*d*. Because the second occurrence of the transient 210 is an artifact created by processing, the echo can be removed to preserve the integrity of the re-synthesized audio signal. In an implementation, because the copies of the transient 210 appearing within the frames 215*e*-215*h* eventually will be removed, the copies of the transient 210 need not be rotated within the frames 215*e*-215*h*.

Figure 5:
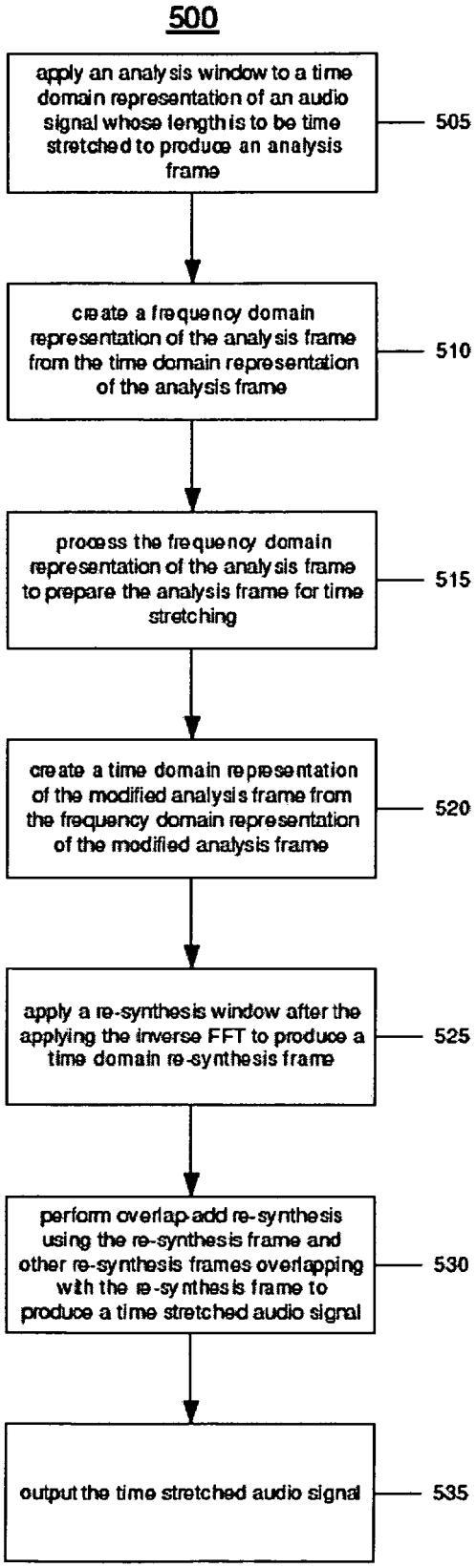
FIGS. 5 and 7 are flowcharts of processes for time stretching an audio signal.

Referring to FIG. 5, a time stretching process 500 is used to adjust a time scale associated with a digital audio signal. The process 500 can be executed by a system for processing audio signals, such as a phase vocoder. Frequency domain representations of analysis frames, defined by the STFT are generated and processed to prepare the audio signal for time stretching. Time domain representations of the processed analysis frames are created from the corresponding frequency domain representations. Overlap-add re-synthesis is performed to time stretch the audio signal for presentation, storage, or further processing.

The process 500 begins when an analysis window is applied to a time domain representation of an audio signal whose length is to be time stretched (505). The analysis window defines a discrete portion of the audio signal that is to be processed as a whole. Applying the analysis window to the audio signal includes multiplying the weighting function defined by the analysis window by a portion of the audio signal included within the analysis window to produce an analysis frame.

A frequency domain representation of the analysis frame is generated from a time domain representation of the analysis frame (510). In an implementation, the analysis frame represents an analog audio signal that is digitized by sampling the analog waveform at an appropriate rate. The analysis frame can then be transformed using a DFT, such as an FFT. By processing the digitized analysis frame using an FFT, a frequency domain representation of the analysis frame is produced.

The frequency domain representation of the analysis frame can be processed to prepare the analysis frame for time stretching (515). Standard operations on the phase of the frequency domain representation of the audio signal can be used to prepare the analysis frame for time stretching during re-synthesis. For example, phase accumulation may be performed to align phases of sinusoidal components of the analysis frame. A transient occurring in the analysis frame can be aligned and any echoes associated with the transient can be removed. As a result, the transient is audible in the time stretched audio signal only once. Processing of the analysis frame in the frequency domain will be discussed in further detail with respect to FIGS. 6 and 7.

A time domain representation of the modified analysis frame is created from the frequency domain representation of the modified analysis frame (520). For example, an inverse FFT can be applied to the frequency domain representation of the modified analysis frame.

In addition, a re-synthesis window is applied after the inverse FFT to produce a time domain re-synthesis frame (525). In an implementation, the width of the re-synthesis window is defined by the width of the time-domain representation of the modified analysis frame. Furthermore, a position of the re-synthesis window within an output audio signal can be selected based on the amount by which the audio signal will be time scaled during re-synthesis. Applying the re-synthesis window to the modified analysis frame can include multiplying the modified analysis frame by a weighting function defined by the re-synthesis window, thereby producing a re-synthesis frame.

Overlap-add re-synthesis is performed using the re-synthesis frame and other re-synthesis frames overlapping with the re-synthesis frame to time stretch the audio signal (530). The other re-synthesis frames can be created in a similar manner as describe above. Performing overlap-add re-synthesis creates the single time stretched output audio signal. The time stretched audio signal can then be output (535), for example, for storage or presentation. Alternatively or additionally, the time domain representation can be output for further processing. For example, the audio signal can be sampled, transformed, and processed again to change a time scale or another characteristic of the audio signal.

Figure 6:
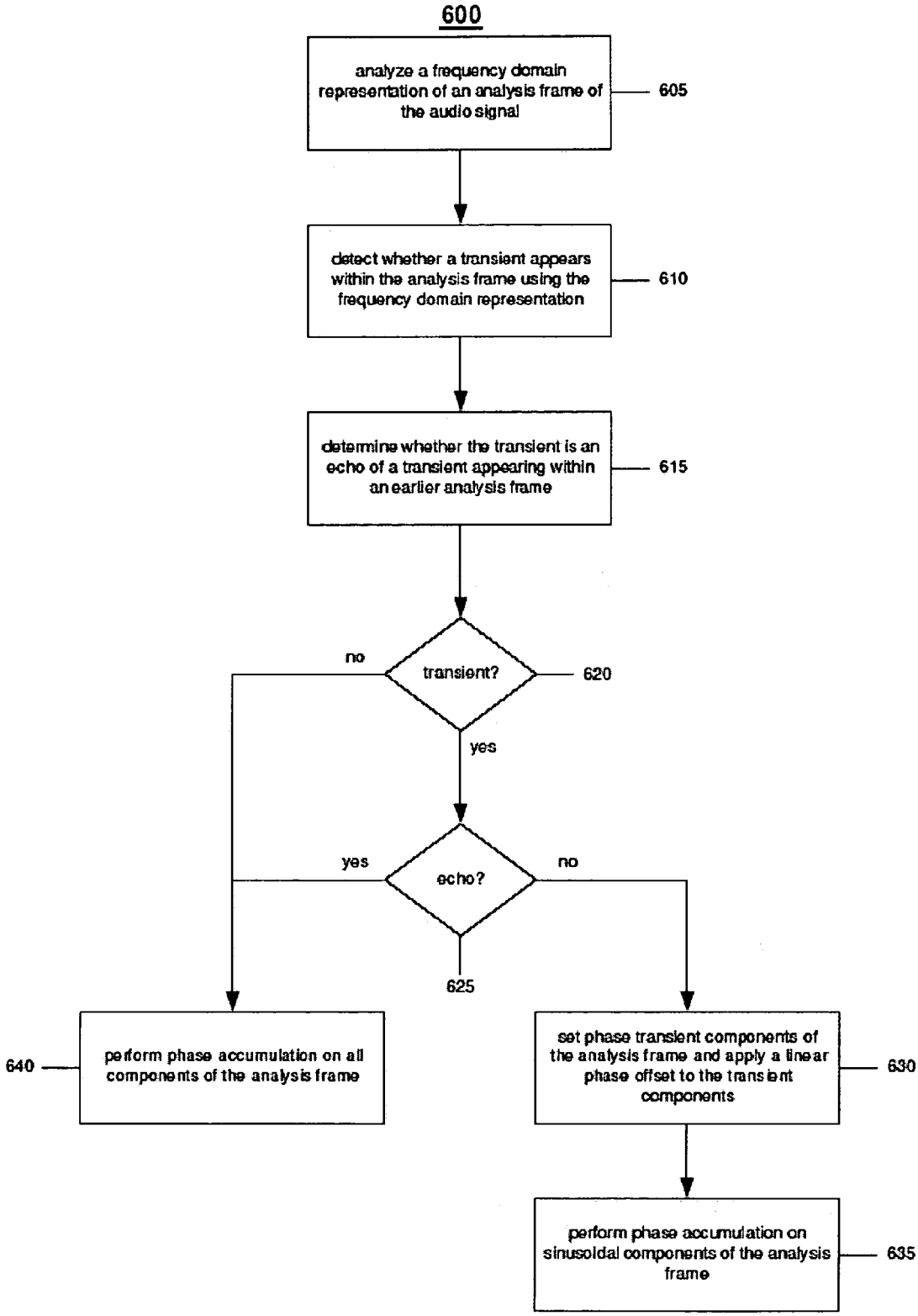
FIG. 6 is a flow chart of a process for rotating transients occurring within analysis frames of an audio signal to align repeated transients in adjacent analysis frames.

Referring to FIG. 6, a phase modification process 600 is used to process a frequency domain representation of an analysis frame in preparation for time stretching of the audio signal. The process 600 represents one implementation of the operation 515 from the process 500 of FIG. 5. Transients are detected and aligned such that each transient that appears within the audio signal is audible only once in the time stretched version of the audio signal. Consequently, echoes of the transients can be cancelled from the time stretched version of the audio signal. Furthermore, sinusoidal components of analysis frame are aligned for proper aggregation during re-synthesis.

A frequency domain representation of an analysis frame defined by an analysis window of the audio signal is analyzed (605). For example, the audio signal can be the audio signal 205 of FIGS. 2-4, and the analysis window can be an analysis window used to create one of the frames 215*a*-215*q* of FIGS. 2-4. Analyzing the analysis frame can include selecting the analysis frame from the audio signal, transforming the analysis frame from the time domain to the frequency domain, and identifying spectral characteristics of the analysis frame.

While analyzing the analysis frame, a transient that appears within the analysis frame can be detected using the frequency domain representation (610). As described above, a transient typically is characterized by a sharp increase and decrease in amplitude that occur over a short period of time. Spectral characteristics of the frequency domain representation of the analysis frame indicate whether such an increase and decrease in amplitude is included in the analysis frame. In an implementation, spectral characteristics of a frequency domain representation of a previous analysis frame may be compared to the spectral characteristics of the frequency domain representation of the analysis frame to determine whether a transient appears within the analysis frame.

In addition, a determination is made as to whether the transient is an echo of a transient appearing within an earlier analysis frame (615). The transient is classified as an echo of an earlier occurring transient if the transient cannot be rotated for alignment with the earlier occurring transient. It will not be possible to align the two transients if, for example, the analysis frames that include the transients do not overlap or if a time at which the transient appears in one of the analysis frames is not included in the second of the analysis frames. If more than the threshold number of analysis frames occur between the two analysis frames, the offset between the two analysis frames may be too large for the two transients to be aligned.

The determination of whether the transient is an echo of a transient appearing within an earlier analysis frame depends on the amount of time by which the transient would need to be shifted to be aligned with the earlier transient, as well as the time at which the transient appears within the analysis frame. By rotating the analysis frame, the transient can only be shifted to a time that occurs within the analysis frame. Therefore, if the transient would need to be shifted to a time outside of the analysis frame in order to be aligned with the earlier transient, then the transients cannot be aligned and the subsequent transient is an echo of the earlier transient If the analysis frame includes a transient (620), and if the transient is not an echo of an earlier occurring transient (625), then the transient may be rotated for alignment with the earlier occurring transient. To do so, the phase of the transient components is set to its original value in the analysis frame, and a linear phase offset is applied to the transient components (630). Applying the linear phase offset to the detected transient causes the detected transient to be rotated to align the detected transient with transients that appear within other analysis frames, because adding a phase offset to the frequency domain representation causes a corresponding time shift in the time domain.

Rotating the transient components includes shifting the transient components, which can result in the transient components being shifted beyond the bounds of the analysis frame. The transient components that have been shifted beyond the bounds of the analysis frame can be repositioned to the opposite end of the analysis frame, where space has been created as a result of the shift. In other words, the transient components are shifted as if the end of the analysis frame has been wrapped around to the beginning of the analysis frame.

The amount of the offset that is applied to the transient components depends on a factor by which the audio signal is being time stretched. More particularly, the amount of the offset depends on the difference between the input step size and the output step size of the audio signal, because the input step size and the output step size identify the stretching factor, as described above. For example, as illustrated in FIG. 3, the difference between the input step size and the output step size causes the transients that appear in adjacent analysis frames to be offset. The transient components are rotated to counteract this offset.

Furthermore, the amount by which the analysis frame is rotated also can depend on the number of previous analysis frames that have included the transient. The analysis frame can be rotated to align the transient with a first appearance of the transient. The amount of time between the first appearance of the transient and the appearance of the transient within the analysis frame may be the product of the offset between adjacent analysis frames and the number of consecutive analysis frames that have included the transient.

In addition to modifying the phase of the transient components of the analysis frame when a transient that is not an echo of an earlier transient is detected (615, 620), the phase accumulation is performed on steady-state sinusoidal components of analysis frame (635). The phase accumulation can use the frequency domain representation of the analysis frame to modify the phase of the sinusoidal components. Phase accumulation aligns the phases of the sinusoidal components for proper aggregation during re-synthesis of the audio signal.

This phase accumulation is a standard technique as used in typical time stretching algorithms in phase vocoders.

If a transient is not detected within the analysis frame (615), or if a detected transient is an echo of an earlier transient (620), then phase accumulation may be performed on all components of the analysis frame (640). In such a case, if the analysis frame includes a transient, performing phase accumulation blends the transient across the analysis frame by diffusing the transient in the re-synthesized audio signal.

Figure 7:
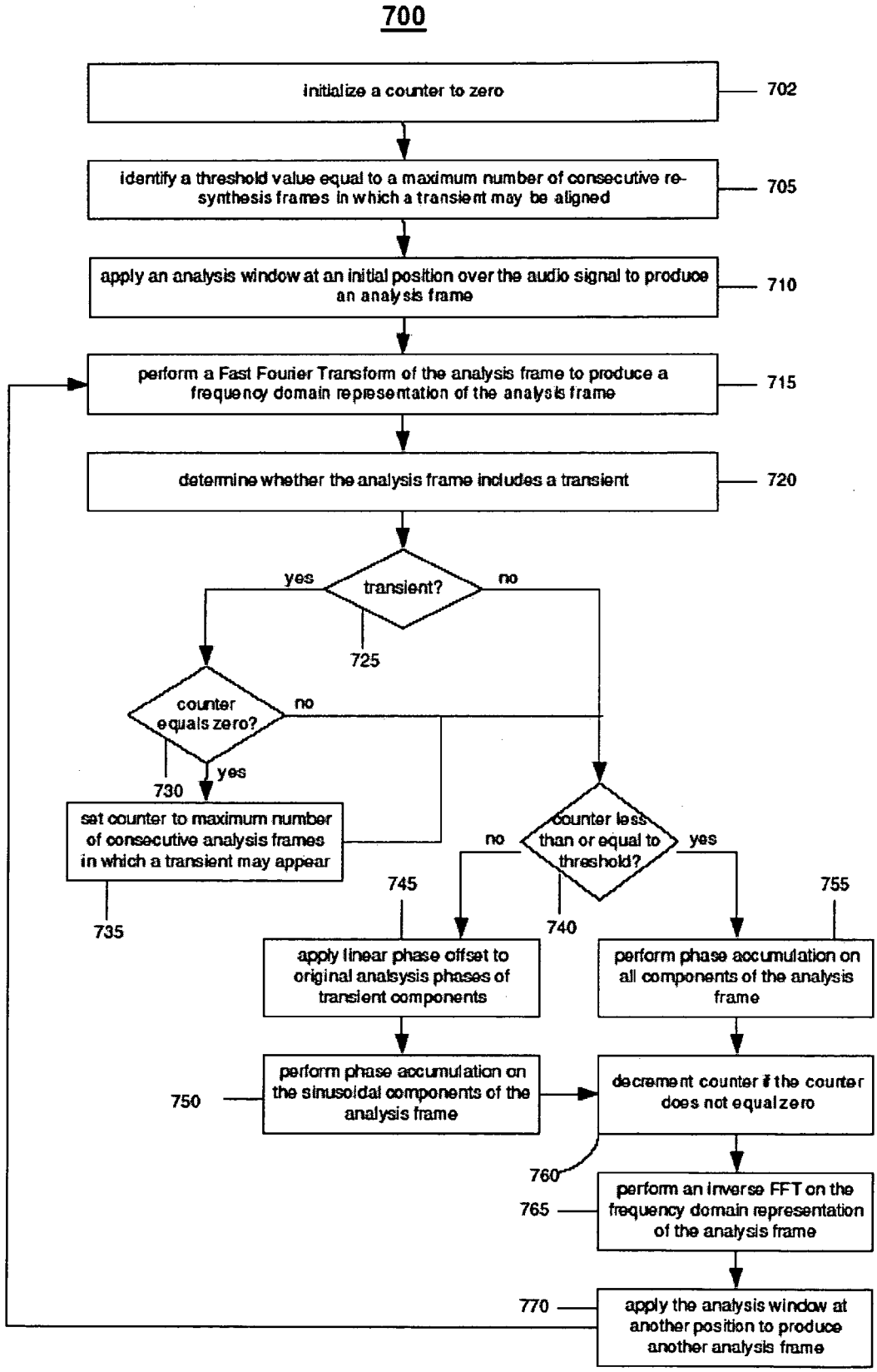

Referring to FIG. 7, a time stretching process 700 represents an implementation of the process 500 of FIG. 5. The time stretching process 700 operates on subsequent analysis windows of the audio signal to identify, align, and eliminate transients appearing within the audio signal as appropriate. Once the phases of the analysis frames have been modified appropriately, overlap-add re-synthesis may be used to reassemble and to time stretch the audio signal.

A counter is initialized to zero (702). In addition a threshold value is identified as the difference between a maximum number of consecutive analysis frames in which a transient may appear and a maximum number of consecutive re-synthesis frames in which a transient may be aligned (705). The maximum number of consecutive analysis frames in which a transient may appear represents the maximum number of analysis frames that can include at least one overlapping point in time. Similarly, the maximum number of consecutive re-synthesis frames in which a transient may be aligned represents the maximum number of re-synthesis frames that can include at least one overlapping point in time. The two maximum numbers can be calculated based on the width of analysis frames of the audio signal, the input step size of the analysis frames, and the output step size of the re-synthesis frames. Therefore, the identified threshold represents a number of re-synthesis frames in which a transient can appear as an echo of an earlier transient. In an implementation, the identified threshold may be tuned by a user.

An analysis window is applied at an initial position over the audio signal (710). For example, the analysis window can be placed at the beginning of the audio signal. Applying the analysis window to the audio signal at the initial position multiplies the analysis window by a portion of the audio signal within the analysis window to produce an analysis frame. An FFT of the analysis frame is performed to produce a frequency domain representation of the analysis frame (715).

A determination is made as to whether the analysis frame includes a transient (720, 725). For example, spectral characteristics of a frequency domain representation of the analysis frame can be analyzed for indications of a transient. If a transient is identified, then a determination of whether the counter equals zero is made (730). The counter having a value of zero at this point indicates that any previously detected transients have been processed fully and that processing of a new transient may begin. Therefore, the counter is set to a maximum number of consecutive analysis frames in which a transient may appear (735). In general, the counter indicates a number of remaining analysis frames in which a copy of a transient may appear. The counter having a value that is not equal to zero indicates that a transient event has been detected, either in this or an earlier analysis frame, and is being processed to align as many copies of the transient as possible and to eliminate the echo of other copies of the transient.

Regardless of whether a transient was detected (725), a determination is made as to whether the counter is less than or equal to the identified threshold (740). The counter always has a value between zero and the maximum number of consecutive analysis frames in which a transient may appear. Therefore, determining whether the counter is less than or equal to the identified threshold includes determining whether the counter has a value between zero and the identified threshold.

The counter having a value greater than the identified threshold indicates that the transient still may be aligned with other copies of the transient that appear in earlier analysis frames, if any exist. Therefore, the original analysis phase is used, and a linear phase offset then is added to the transient components of the analysis frame (745). In addition, phase accumulation is performed on sinusoidal components of the analysis frame (750).

The counter having a value less than or equal to the identified threshold indicates that the transient may not be aligned with other copies of the transient that appear in earlier analysis frames. The counter having a value greater than zero but less than or equal to the identified threshold also indicates that an echo of the transient still may appear within the analysis frame. Consequently, the transient should be blended into the analysis frame. Similarly, the counter having a value of zero indicates that a transient does not appear within the analysis frame. In either case, phase accumulation is performed on all components of the analysis frame (755).

At this point, the counter is decremented, as long as the counter does not already equal zero (760). Decrementing the counter indicates that that one of the maximum number of analysis frames in which the transient may appear has been processed.

Once the phase of the analysis frame has been modified appropriately, an inverse FFT is performed on the frequency domain representation of the modified analysis frame (765). The inverse FFT produces a time domain representation of the analysis frame to be used during overlap-add re-synthesis of the audio signal. At this point, processing of the portion of the audio signal included in the frame is complete. Accordingly, the analysis window can be applied to a different portion of the audio signal to produce another analysis frame (770). The portion of the audio signal identified by the new location of the analysis window can be processed based on whether the new portion includes a transient that can be aligned with one or more earlier transients. In this manner, it is possible to reposition, or slide, the analysis window along the entire length of the audio signal, and overlap-add re-synthesis can be performed to complete the audio signal processing.

Figure 8:
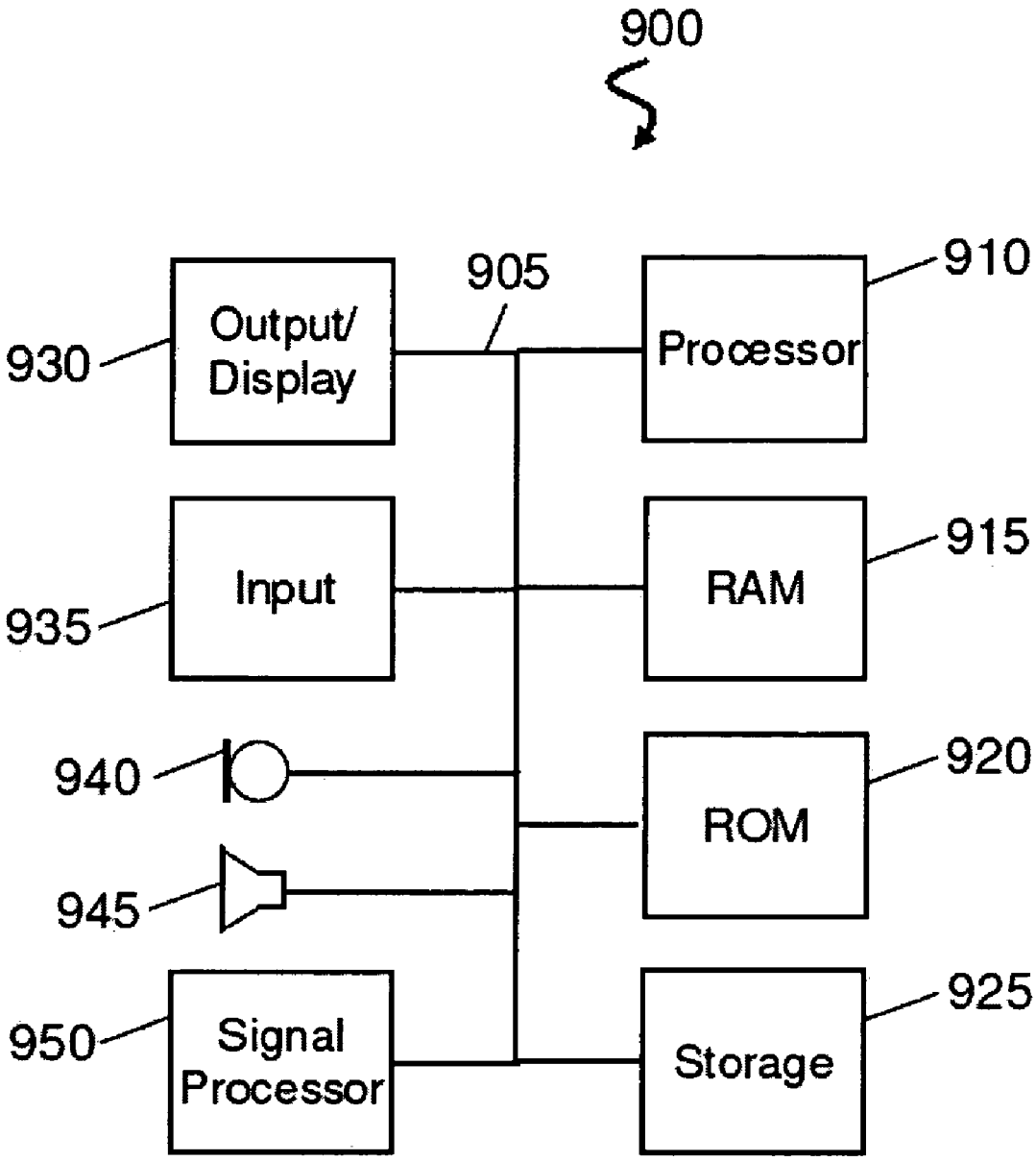
FIG. 8 is a block diagram of a computer system.

Referring to FIG. 8, a computer system 900 can be used to implement the techniques described above for processing a digital audio signal. The computer system 900 includes a microphone 940 for receiving an audio signal. The microphone 940 is coupled to a bus 905 that can be used to transfer the audio signal to one or more additional components. The bus 905 can be comprised of one or more physical busses and permits communication between all of the components included in the computer system 900. A processor 910 can be used to digitize the received audio signal and the resulting digitized audio signal can be transferred to storage 925, such as a hard drive, flash drive, or other readable and writeable medium. Alternately, the digitized audio signal can be stored in a random access memory (RAM) 915.

The digitized audio signals available in the computer system 900 can be displayed along with operations involving the digital audio signals via an output/display device 930, such as a monitor, liquid crystal display panel, printer, or other such output device. An input 935 comprising one or more input devices also can be included to receive instructions and information. For example, the input 935 can include one or more of a mouse, a keyboard, a touch pad, a touch screen, a joystick, a cable interface, and any other such input devices known in the art. Further, audio signals also can be received by the computer system 900 through the input 935. Additionally, a read only memory (ROM) 920 can be included in the computer system 900 for storing information, such as sound processing parameters and instructions.

An audio signal, or any portion thereof, can be processed in the computer system 900 using the processor 910. In addition to digitizing received audio signals, the processor 910 also can be used to perform editing and playback functions, including the rate modified playback techniques described above. Further, the audio signal processing functions, including rate modified playback, also can be performed by a signal processor 950. Thus, the processor 910 and the signal processor 950 can perform any portion of the audio signal processing functions independently or cooperatively. Additionally, the computer system 900 includes an output 930, such as a speaker or an audio interface, through which audio signals can be played back.

Figure 9:
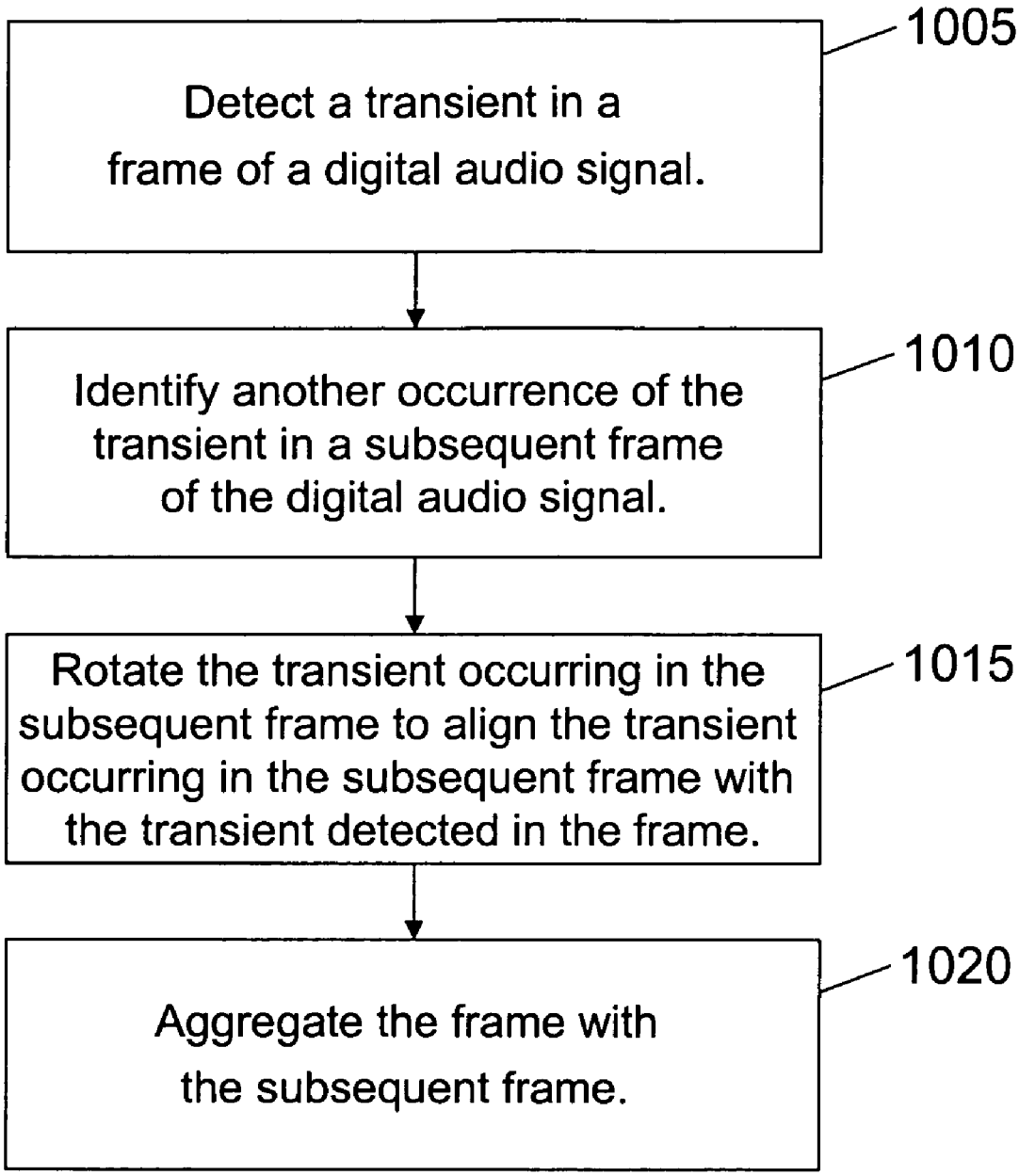
FIG. 9 describes a method of avoiding a transient echo during time stretching of a digital audio signal.

FIG. 9 describes a method of avoiding a transient echo during time stretching of a digital audio signal. In a first step 1005, a transient is detected in a frame of a digital audio signal. The second step 1010 is to identify another occurrence of the transient in a subsequent frame of the digital audio signal. In the third step 1015, the transient occurring in the subsequent frame is rotated to align the transient occurring in the subsequent frame with the transient detected in the frame. Once the transients are aligned, the fourth step 1020 is to aggregate the frame with the subsequent frame.

A number of implementations have been disclosed herein. Nevertheless, it will be understood that various modifications may be made without departing from the spirit and scope of the claims. Accordingly, other implementations are within the scope of the following claims.

What is claimed is:

1. A method of aggregating a transient during time stitching of a digital audio signal, the method comprising:

applying, using a processor, a time stretching process to a digital audio signal to alter a length of the digital audio signal;

detecting a transient in a frame of the time stretched digital audio signal;

identifying another occurrence of the transient in a subsequent frame of the time stretched digital audio signal;

rotating the transient occurring in the subsequent frame to align the transient occurring in the subsequent frame with the transient detected in the frame; and aggregating the frame with the subsequent frame to consolidate the transient.

2. The method of claim 1, wherein rotating the transient comprises applying a linear phase offset to one or more components associated with the transient occurring in the subsequent frame.

3. The method of claim 1, wherein detecting a transient in a frame comprises detecting one or more spectral characteristics associated with a frequency domain representation of the frame that are representative of a transient.

4. The method of claim 1, further comprising performing phase accumulation on one or more sinusoidal components associated with the frame.

5. The method of claim 1, further comprising:

identifying another occurrence of the transient in another subsequent frame of the time stretched digital audio signal;

determining that the occurrence of the transient in the another subsequent frame cannot be aligned with the transient detected in the frame; and blending the occurrence of the transient in the another subsequent frame across the another subsequent frame.

6. The method of claim 5, wherein blending the occurrence of the transient comprises performing phase accumulation on one or more frequency components associated with the another subsequent frame.

7. A method of avoiding a transient echo during time stretching of a digital audio signal, the method comprising:

applying, using a processor, a time stretching process to a digital audio signal to alter a length of the digital audio signal;

detecting a transient in a frame of the time stretched digital audio signal;

identifying another occurrence of the transient in at least one subsequent frame of the time stretched digital audio signal;

determining that the occurrence of the transient in the at least one subsequent frame cannot be aligned with the transient detected in the frame; and blending the occurrence of the transient in the at least one subsequent frame across the at least one subsequent frame.

8. The method of claim 7, wherein blending the occurrence of the transient comprises performing phase accumulation on one or more frequency components associated with the at least one subsequent frame.

9. The method of claim 7, wherein detecting a transient in a frame comprises detecting one or more spectral characteristics associated with a frequency domain representation of the frame that are representative of a transient.

10. A computer program product, tangibly stored on a storage medium readable by a computer, comprising machine-readable instructions operable to cause a computer to perform operations comprising:

applying a time stretching process to a digital audio signal to alter a length of the digital audio signal;

detecting a transient in a frame of the time stretched digital audio signal;

identifying another occurrence of the transient in a subsequent frame of the time stretched digital audio signal;

rotating the transient occurring in the subsequent frame to align the transient occurring in the subsequent frame with the transient detected in the frame; and aggregating the frame with the subsequent frame to consolidate the transient.

11. The computer program product of claim 10, wherein the machine-readable instructions for rotating are further operable to cause a computer to perform operations comprising applying a linear phase offset to one or more components associated with the transient occurring in the subsequent frame.

12. The computer program product of claim 10, wherein the machine-readable instructions for detecting a transient in a frame are further operable to cause a computer to perform operations comprising detecting one or more spectral characteristics associated with a frequency domain representation of the frame that are representative of a transient.

13. The computer program product of claim 10, wherein the machine-readable instructions are further operable to cause a computer to perform operations comprising performing phase accumulation on one or more sinusoidal components associated with the frame.

14. The computer program product of claim 10, wherein the machine-readable instructions are further operable to cause a computer to perform operations comprising:

identifying another occurrence of the transient in another subsequent frame of the time stretched digital audio signal;

determining that the occurrence of the transient in the another subsequent frame cannot be aligned with the transient detected in the frame; and blending the occurrence of the transient in the another subsequent frame across the another subsequent frame.

15. The computer program product of claim 14, wherein the machine-readable instructions for blending the occurrence of the transient are further operable to cause a computer to perform operations comprising performing phase accumulation on one or more frequency components associated with the another subsequent frame.

16. A computer program product, tangibly stored on a storage medium readable by a computer, comprising machine-readable instructions operable to cause a computer to perform operations comprising:

applying a time stretching process to a digital audio signal to alter a length of the digital audio signal;

detecting a transient in a frame of the time stretched digital audio signal;

identifying another occurrence of the transient in at least one subsequent frame of the time stretched digital audio signal;

determining that the occurrence of the transient in the at least one subsequent frame cannot be aligned with the transient detected in the frame; and blending the occurrence of the transient in the at least one subsequent frame across the at least one subsequent frame.

17. The computer program product of claim 16, wherein the machine-readable instructions for blending the occurrence of the transient are further operable to cause a computer to perform operations comprising performing phase accumulation on one or more frequency components associated with the at least one subsequent frame.

18. The computer program product of claim 16, wherein the machine-readable instructions for detecting a transient in a frame are further operable to cause a computer to perform operations comprising detecting one or more spectral characteristics associated with a frequency domain representation of the frame that are representative of a transient.

19. A system for aggregating a transient during time stitching of a digital audio signal, the system comprising:

a digital audio signal stored on a storage device; and a computing system including processor electronics configured to perform operations comprising:

applying a time stretching process to the digital audio signal to alter a length of the digital audio signal;

detecting a transient in a frame of the time stretched digital audio signal;

identifying another occurrence of the transient in a subsequent frame of the time stretched digital audio signal;

rotating the transient occurrence in the subsequent frame to align the transient occurring the subsequent frame with the transient detected in the frame; and aggregating the frame with the subsequent frame to consolidate the transient.

20. The system of claim 19, wherein the processor electronics are further configured to perform operations comprising rotating the transient by applying a linear phase offset to one or more components associated with the transient occurring in the subsequent frame.

21. The system of claim 19, wherein the processor electronics are further configured to perform operations comprising performing phase accumulation on one or more sinusoidal components associated with the frame.

22. The system of claim 19, wherein the processor electronics are further configured to perform operations comprising:

identifying another occurrence of the transient in another subsequent frame of the time stretched digital audio signal;

determining that the occurrence of the transient in the another subsequent frame cannot be aligned with the transient detected in the frame; and blending the occurrence of the transient in the another subsequent frame across the another subsequent frame.

23. A system for avoiding a transient echo during time stretching of a digital audio signal, the system comprising:

a digital audio signal stored on a storage device; and a computing system including processor electronics configured to perform operations comprising:

applying a time stretching process to the digital audio signal to alter a length of the digital audio signal;

detecting a transient in a frame of the time stretched digital audio signal;

identifying another occurrence of the transient in at least one subsequent frame of the time stretched digital audio signal;

determining that the occurrence of the transient in the at least one subsequent frame cannot be aligned with the transient detected in the frame; and blending the occurrence of the transient in the at least one subsequent frame across the at least one subsequent frame.

24. The system of claim 23, wherein the processor electronics configured to blend the occurrence of the transient are further configured to perform operations comprising performing phase accumulation on one or more frequency components associated with the at least one subsequent frame.

* * * * *